US006533164B1

(12) United States Patent
Correll

(10) Patent No.: US 6,533,164 B1
(45) Date of Patent: Mar. 18, 2003

(54) MULTI-FEATURED BLANK FOR A FOOD CARTON

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 0 days.

(21) Appl. No.: 10/119,974

(22) Filed: Apr. 10, 2002

(51) Int. Cl.[7] ..... B65D 5/00

(52) U.S. Cl. ..... 229/150; 229/149; 229/178; 229/190; 229/930; 229/935

(58) Field of Search ..... 229/149, 150, 229/178, 190, 930, 931, 933, 934, 935

(56) References Cited

U.S. PATENT DOCUMENTS 1,824,927 A * 9/1931 Powell ..... 229/150
1,894,873 A * 1/1933 Johnson ..... 229/933
3,064,877 A * 11/1962 Forrer et al. ..... 229/150
3,233,818 A * 2/1966 Bixler et al. ..... 229/150
3,542,569 A * 11/1970 Farquhar ..... 229/150
4,197,980 A * 4/1980 Johnson ..... 229/178
4,421,267 A * 12/1983 Wischoff ..... 229/150
4,511,079 A * 4/1985 Lopez ..... 229/178
4,674,676 A * 6/1987 Sandel et al. ..... 229/149
4,923,113 A * 5/1990 Guijarro ..... 229/178
5,692,672 A * 12/1997 Hunt ..... 229/931
5,873,517 A * 2/1999 Lisbon ..... 229/933

* cited by examiner

*Primary Examiner*—Gary E. Elkins

(57) ABSTRACT

A box blank for a pizza carton or other food carton that comprises one or more of the following features: (1) a structure that enables multiple blanks to be mated end-to-end for a material savings, (2) a rigidizing fold line structure for connecting a flap to a wall panel in a way that minimizes flap movement during box blank manuf acture, and (3) a frictionizing slot-forming slit that creates a tight-gripping cover flap receiving slot in the erected carton.

2 Claims, 2 Drawing Sheets

MULTI-FEATURED BLANK FOR A FOOD CARTON

FIELD OF THE INVENTION

This invention relates to packaging in general and in particular to box blanks for pizza cartons and other food cartons made of semi-rigid, foldable material.

BACKGROUND OF THE INVENTION

In the pizza and food-to-go industries there are numerous types of cartons made of foldable material. Perhaps the most prevalent of these materials is corrugated paperboard. Cartons made of corrugated paperboard are erected from a flat sheet of material known as a box blank, or blank, for short.

At least three problems exist with many of the current types of blanks used for pizza and food cartons. First, the blank can require a relatively large amount of material, particularly the blanks for those cartons that utilize the traditional double-panel, or roll-over, front wall structure.

Second, during manufacture, corner flaps attached to the ends of side walls at a fold line tend to bend at the fold line as the blanks are released from the cutting dies and as they proceed down the production line. This is especially the case with blanks made of thinner types of corrugated paperboard, such as E-flute and F-flute. A folded, or unaligned, flap can cause problems in production, sometimes requiring the production line to be slowed down or stopped.

Third, some blanks use a cover-locking structure that involves inserting a cover front flap into a flap-receiving slot in the front wall of the carton. In order for the slot to tightly grip the cover flap, the slot must be relatively narrow in the front-to-back, or width-type, dimension. However, with this configuration it can be difficult and time-consuming to fit the cover flap into the slot. To make it easier to quickly fit the cover flap into the slot, a wider flap-receiving slot can be used. However, when this is done the slot often fails to tightly grip and hold the cover flap in place, particularly after the carton has been opened and then re-closed.

Regarding the first problem (i.e., use of excessive material for making the blank), box manufacturers have designed the structure of box blanks so that multiple side-by-side blanks mate, or nest, together during the die-cutting phase of manufacture. This reduces the amount of material needed for manufacture of each blank. The process of mating adjacent blanks has been used as a material-reduction technique for the last hundred years or so. As a result, hundreds of mated side-by-side arrangements of multiple blanks have been invented. However, no arrangement has been created that accommodates the typical structure of a pizza carton or food carton. That structure comprises a bottom panel, a rear wall attached to the bottom panel, a cover panel attached to the rear wall, a cover front flap attached to the front edge of the cover panel, and a front wall structure opposing the rear wall and comprising a front wall and an ancillary panel structure attached to the front wall. So there has remained a need for a mating arrangement for typical food carton box blanks that effects a savings of material in manufacture of the blanks.

Regarding the second problem (i.e., the folding or misalignment of corner flaps during blank manufacture), the typical solution has been to create a "tack," or narrow strip of material, between the flap and an adjacent panel of the blank. However, this requires the end-user to have to take the time to break the "tack" before erecting the blank into a box. As a result, there has remained a need for "rigidized" corner flaps on a box blank without resorting to the inconvenient "tack." The typical fold line used for connecting a corner flap to a, wall panel consists of either (a) a score (i.e., crease) in the board or (b) a series of aligned slits, sometimes referred to as a perforation line, or perf line. A fold line of aligned slits usually takes the form of either one-quarter inch slits separated by a one-quarter inch score or one-eighth inch slits separated by a one-eighth inch score. There has been no inventive prior art pertaining to fold line structure. So there has remained a need for a fold line structure that results in rigidizing or holding corner flaps in place during manufacture of the blank.

Regarding the third problem (i.e., lack of a slot-forming structure that results in a flap-receiving slot that's both easy to insert the cover flap into and tight-gripping enough to hold the flap within the slot once it's inserted), as regards double-panel wall structures where an inner wall panel is disposed parallel to an outer wall panel, there has been no inventive prior art pertaining to cover flap receiving slots. So there has remained a need for a slot-forming structure that results in a flap-receiving slot that is both easy to use and tight-gripping of the cover flap.

Accordingly, it would be highly desirable to provide a box blank that overcomes one, two, or all three of the above-described problems. None of the three problems have been solved by the prior art, but they are solved by my invention.

SUMMARY OF THE INVENTION

My invention is a box blank that provides one or more of the following three features:

1. End-to-end mating of multiple blanks wherein a cover front flap of a first blank is disposed within a notch in the front wall structure of a second blank, thereby effecting a savings of material;
2. A rigidizing fold line used in attaching a flap to an end of a wall panel, wherein the rigidizing fold line comprises at least one indentation portion and at least one non-indentation portion, thereby reducing movement of the flap while in the manufacturing process; and
3. A frictionizing slot-forming slit disposed within a multi-panel wall structure of a box blank, wherein the frictionizing slot-forming slit has a central-slit portion and at least one end-slit portion that's disposed at an obtuse angle to the central-slit portion, thereby providing for a trapezoidal-shaped flap-receiving slot with an acutely angled end section in the erected carton, and which, in turn, enables the slot to grip, or pinch, the side edge of a cover flap and hold it within the slot.

My invention typically would be associated with blanks used for creating cartons for food products; however, it could take other forms for other purposes, as well.

A complete understanding of the invention can be obtained from the detailed description that follows.

OBJECT AND ADVANTAGES

The main object of my invention is (a) a material efficient box blank that's (b) easy to manufacture and (c) which provides for a cover-locking slot that allows for easy cover flap insertion while also providing a tight grip on the flap.

The advantages of my invention are cost savings, production simplicity, and cover closure enhancement on a food carton.

Further objects and advantages of the invention will become apparent from consideration of the following detailed description, related drawings, and appended claims.

LIST OF REFERENCE NUMERALS

Figure 1:
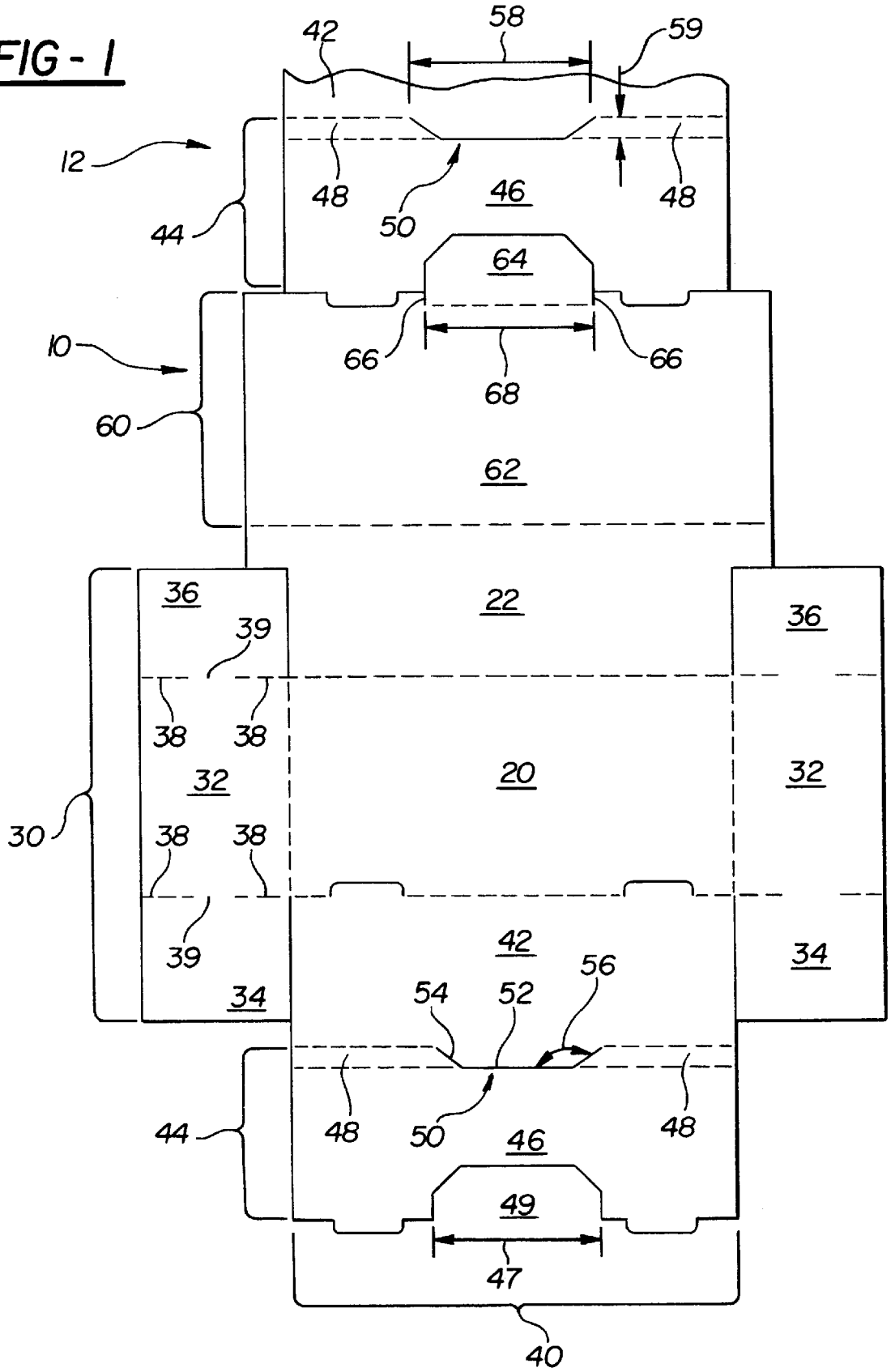
FIG. 1 is a plan view of multiple box blanks of a preferred embodiment of the invention.

10 first blank of the preferred embodiment
12 second blank of the preferred embodiment
20 bottom panel
22 rear wall
30 side wall structure
32 wall panel
34 front corner flap
36 rear corner flap
38 indentation portion of rigidizing fold line
39 non-indentation portion of rigidizing fold line
40 front wall structure
42 front wall
44 ancillary panel structure
46 inner wall panel
47 width of notch
48 connector strip
49 notch
50 frictionizing slot-forming slit
52 central-slit portion
54 end-slit portion
56 obtuse angle
58 length of slot-forming slit
59 width-type dimension of slot-forming slit
60 cover
62 cover panel
64 cover front flap
66 side edge of cover front flap
68 width of cover front flap
70 prior art slot-forming slit
72 trapezoidal shape of flap-receiving slot

DESCRIPTION OF THE PREFERRED EMBODIMENT

Referring now to FIG. 1, there is illustrated a preferred embodiment of the invention in the format of first and second corrugated paperboard blanks in a mated end-to-end arrangement. The intended use for the embodiment is as a food carton. However, it will be appreciated, as the description proceeds, that my invention may be realized in different embodiments and may be used in other applications.

FIG. 1 shows a first box blank 10 and a second box blank 12. For simplicity, only a partial section of blank 12 is shown. However, it is to be understood that the remaining (unshown) structure of blank 12 is the same as that of blank 10. Therefore, whatever is shown and described pertaining to blank 10 also applies to blank 12.

Further, it is noted that the blanks are bilaterally symmetrical. Therefore, pairs of opposing like components are to be found, with one item of the pair on each side of the blank. For simplicity of labeling, each component of the opposing pair will have the same reference numeral. Also, a pair may be indicated by a numeral on one side of the drawing only. Where this occurs, it is to be understood that the discussion also applies to the corresponding component on the other side, even though that component may not be numerically labeled.

Referring now to blank 10, there is a bottom panel 20, a rear wall 22 hingedly attached to bottom panel 20, opposing left and right side wall structures 30, a front wall structure 40 opposing rear wall 22, and a cover 60.

Cover 60 comprises a cover panel 62 hingedly attached to rear wall 22 and a cover front flap 64 hingedly attached to a front edge of cover panel 62. Flap 64 has left and right side edges 66 and a width 68.

Side wall structure 30 comprises a wall panel 32 and front and rear corner flaps 34 and 36, respectively. Each of the corner flaps is attached to the wall panel at a rigidizing fold line.

As defined herein, a "rigidizing fold line" is a fold line that comprises at least one indentation portion and at least one non-indentation portion. An "indentation portion" of a fold line is that part of the fold line resulting from some sort of alteration to the board. The typical alterations are (a) a score, or crease, and (b) a perforation line (i.e., series of aligned slits). A "non-indentation portion" of a fold line is that part of the fold line that has no alteration or indentation to the board.

As used herein, to qualify as a non-indentation portion, that portion of unaltered board must be at least eight millimeters long. The space that exists between the slits of a perforation line do not qualify as a non-indentation portion of a fold line. In side wall structure 30, the indentation portions of the rigidized fold line that connects flaps 34, 36 to wall panel 32 are designated by the numeral 38. The non-indentation portion of the fold line is designated by numeral 39 and, even though it has no visible characteristic, it is assumed that it exists in the space between the indentation portions 38. Non-indentation portion 39 is at least eight millimeters long and, preferably, at least fifteen millimeters long. During manufacture of the blank, non-indentation portion 39 provides rigidity to flaps 34, 36 and, thereby, helps to keep them in place, or coplanar with the rest of the blank, during the die-cutting and production process.

Front wall structure 40 comprises a front wall 42, an ancillary panel structure 44, and a frictionizing slot-forming slit 50. Ancillary panel structure 44 comprises an inner wall panel 46 and a pair of connector strips 48 that connect wall panel 46 to the top edge of front wall 42. Along the outer edge of inner wall panel 46 is a notch. The general space created by the notch is indicated by numeral 49. So, in effect, the notch is designated by numeral 49. Notch 49 has a width 47, which happens to be equal to cover flap width 68.

After blank 10 has been erected into a carton, front wall structure 40 constitutes a double-panel wall structure in which front wall 42 is an outer wall panel that's perpendicular to bottom panel 20, inner wall panel 46 is an inner panel that's parallel to front wall 42 and disposed interior to it, and connector strips 48 are perpendicular to the front wall and the inner wall panel. In the carton format, corner flaps 34 are disposed between front wall 42 and inner wall panel 46.

As defined herein, a "slot-forming slit" is a slit in the blank that opens into a flap-receiving slot in the carton after the blank has been erected into a carton.

Figure 2:
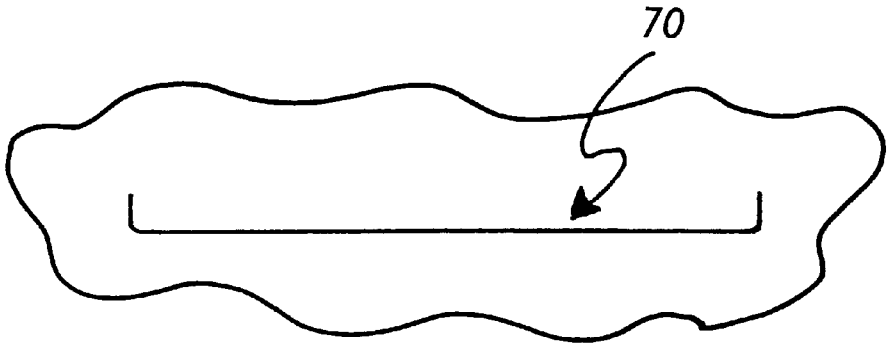
FIG–2 PRIOR ART
FIG. 2 is a prior art configuration of a slot-forming slit.

A "frictionizing slot-forming slit" is a slot-forming slit that comprises a central-slit portion and at least one end-slit portion. An "end-slit portion" is a portion of the slit that is disposed at the end of the central-end portion and is at least six millimeters long and disposed at an obtuse angle to the central-slit portion. In frictionizing slot-forming slit 50, the central-slit portion is designated by numeral 52 and the end-slit portion is designated by numeral 54. There are a pair of end-slit portions 54, one at each end of central-slit portion 52 (although only one end-slit portion is labeled). To compare slot-forming slit 50 to a standard slot-forming slit, view FIG. 2 which shows a typical prior art slot-forming slit 70.

Slot-forming slit 50 is disposed between connector strips 48 and is approximately aligned therewith. Further, slot-forming slit 50 has a length 58 and a width-type dimension 59 (which are labeled on blank 12). Length 58 is equal to cover flap width 68. Finally, width-type dimension 59 is at least one and one-half (1.5) times the length of the thickness of the corrugated sheet used for making the blank, and is preferably two times the length of the thickness. So, for example, if the thickness of the corrugated sheet is one-eighth inch thick it is recommended that the width-type dimension of the slot-forming slit (and, hence, also the width of the connector strips) be at least one-fourth inch. This will result in the flap-receiving slot having a width dimension that accommodates easy insertion of the cover flap after the blank has been erected into a carton. As a concluding note, it should be understood that the proportional size of the components shown in the drawing of blank 10 are not necessarily recommended proportional sizes but, to the contrary, are exaggerated proportions provided for the purpose of clear illustration of the invention.

Figure 3:
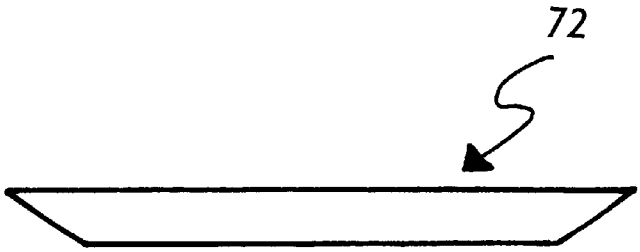
FIG. 3 shows a trapezoidal-shape of a flap-receiving slot resulting from the preferred slot-forming slit.

When blank 10 is erected into a carton, frictionizing slot-forming slit 50 opens into a flap-receiving slot along the top edge of front wall structure 40. When viewed from the top, the slot will be of a non-rectangular shape. Specifically, it will be of a trapezoidal shape and contain an acute angle at each end of the trapezoid. The particular shape of the slot will resemble that of trapezoid 72 shown in FIG. 3. By comparison, when the slot created from prior art slot-forming slit 70 is viewed from the top, it will be of a substantially rectangular shape. When cover flap 64 is inserted into the trapezoidal slot created from frictionizing slot-forming slit 50, side edges 66 of the flap are pinched within the acute angles at the end of the trapezoidal slot, thereby serving to hold the flap within the slot due to increased friction on the side edges of the cover flap.

Mated End-to-end Arrangement

As can be seen in FIG. 1, the instant invention accommodates the configuration of multiple blanks (10 and 12) in a mated end-to-end arrangement. Cover front flap 64 of blank 10 is disposed within notch 49 of blank 12. In the preferred embodiment, notch 49 is the exact shape of cover front flap 64. So notch 49 of blank 12 is completely filled by cover front flap 64 of blank 10. Accordingly, the space associated with notch 49 of blank 12 cannot be labeled in the drawing. (However, the corresponding space associated with notch 49 of blank 10 can be seen.) It should be understood that it's possible for notch 49 to have a contour different from that of cover flap 64. If this were to occur, the alternate configuration would still be considered to fall within the scope of the instant invention. In conclusion, the result of this particular mating arrangement is that it effects a savings of material in the manufacture of multiple blanks.

Erecting the Blank into a Carton

Blank 10 is erected into a carton using the same procedure as employed for erecting a standard square pizza box having a double-panel, or roll-over, front wall. That procedure is essentially as follows. First, fold side wall panels 32 to an upright position and fold front corner flaps 34 inward. Second, fold front wall 42 to an upright position and then fold inner wall panel 46 downward until the outer edge of the panel engages with bottom panel 20 and, thereby, holds panel 46 parallel to front wall 42. Third, fold rear corner flaps 36 inward. Finally, pull cover panel 62 forward and insert cover front flap 64 into the slot created by slot-forming slit 50.

An Alternate Embodiment of the Invention

Other embodiments of the invention are possible. For example, an alternate embodiment can be created by eliminating connector strips 48 in ancillary panel structure 44 and, consequently, attaching inner wall panel 46 directly to front wall 42. With this arrangement, panel 46 would likely be disposed perpendicular (as opposed to parallel) to front wall 42 after blank 10 has been erected into a carton.

Within the drawing of the blank, a fold line between component parts of the invention is depicted with a dashed line. Within the context of this invention, a fold line can be created by a number of means such as, for example, by a crease or score in the board, by a series of aligned spaced short slits in the board, and by a combination of aligned spaced short and long slits. Nonetheless, the entire combination of slits is considered to constitute a single fold line unless otherwise indicated.

In conclusion, as referred to herein, a fold line is any line between two points on the blank along which the board is intended to be folded when the blank is being erected into a carton or when the carton is being manipulated as described herein. The type of fold lines shown in the drawings are presently preferred but it will be appreciated that other methods known to those skilled in the art may be used.

CONCLUSION, RAMIFICATIONS, AND SCOPE

I have disclosed a box blank that provides one or more of the following three features:

1. End-to-end mating of multiple blanks wherein a cover front flap of a first blank is disposed within a notch in the front wall structure of a second blank;
2. A rigidizing fold line that comprises at least one indentation portion and at least one non-indentation portion; and
3. A frictionizing slot-forming slit that has a central-slit portion and at least one end-slit portion that's disposed at an obtuse angle to the central-slit portion.

The illustrated number, size, shape, type, and placement of components represent the preferred embodiment; however, many other combinations and configurations are possible within the scope of the invention.

The foregoing discussion has pertained mainly to packaging food products such as pizza, breadsticks, and the like. However, it should be realized that my invention could be used for other purposes, as well. In conclusion, it is understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

I claim:

1. A box blank made of foldable material and having a rigidizing fold line, said blank being cut and scored to define:

a bottom panel, and a wall structure comprising a wall panel hingedly attached to said bottom panel and a flap hingedly attached to said wall panel at a fold line;

wherein said fold line is a rigidizing fold line comprising at least one indentation portion and at least one non-indentation portion, said non-indentation portion being at least eight millimeters long.

2. A box blank made of corrugated paperboard and erectable into a box having a double-panel wall structure comprising an outer wall panel, an inner wall panel disposed substantially parallel to said outer wall panel, and a flap-receiving slot, said blank being cut and scored to define:

a bottom panel, a rear wall hingedly attached to said bottom panel, a cover comprising a cover panel hingedly attached to said rear wall and a cover flap hingedly attached to said cover panel, a pair of opposing side wall structures each comprising a side wall hingedly attached to said bottom panel, and a front wall structure opposing said rear wall and comprising a front wall hingedly attached to said bottom panel, an ancillary panel structure, and a frictionizing slot-forming slit, said ancillary panel structure comprising an inner wall panel and aligned first and second connector strips, said first connector strip being hingedly attached at a first fold line to said inner wall panel and at a second fold line to said front wall;

wherein said frictionizing slot-forming slit is disposed between said first and second connector strips and comprises a central-slit portion and an end-slit portion, said central-slit portion being substantially aligned with said first fold line and said end-slit portion extending from said second fold line to said central-slit portion and being disposed at an obtuse angle to said central-slit portion.

* * * * *